United States Patent [19]

Atimichuk

[11] Patent Number: 4,628,551

[45] Date of Patent: Dec. 16, 1986

[54] CONVERTIBLE BED CHAIR

[76] Inventor: Stan W. Atimichuk, 262 Durie St., Toronto, Canada, M9S 3G3

[21] Appl. No.: 791,528

[22] Filed: Oct. 25, 1985

Related U.S. Application Data

[63] Continuation-in-part of Ser. No. 575,305, Jan. 30, 1984, abandoned.

[51] Int. Cl.[4] ..... A47C 13/00; A47C 17/13

[52] U.S. Cl. ..... 5/12 R; 5/37 C; 297/112; 297/114

[58] Field of Search ..... 5/12 R, 37 R, 37 B, 5/37 C, 18 R, 18 B, 38, 39, 41, 42, 44 R, 44 B, 56, 481, 46 R, 55 R; 297/112, 114, 105, 87

[56] References Cited

U.S. PATENT DOCUMENTS

| | | | |
|---|---|---|---|
| 500,091 | 6/1893 | Wood | 297/112 |
| 650,498 | 5/1900 | Welles | 297/114 |
| 1,083,424 | 1/1914 | Anderson | 297/114 |
| 1,384,327 | 7/1921 | Linder | 297/112 |
| 2,556,703 | 6/1951 | Paladino | 297/114 |
| 3,867,730 | 2/1975 | Wright . | |
| 4,292,697 | 10/1981 | Alembik . | |
| 4,343,508 | 8/1982 | Heling et al. . | |
| 4,378,609 | 4/1983 | Patterson et al. . | |

FOREIGN PATENT DOCUMENTS

| | | | |
|---|---|---|---|
| 362721 | 9/1938 | Italy | 297/112 |
| 437754 | 11/1935 | United Kingdom | 297/114 |
| 441106 | 1/1936 | United Kingdom | 297/114 |

*Primary Examiner*—Gary L. Smith
*Assistant Examiner*—Vinh Luong
*Attorney, Agent, or Firm*—Harpman & Harpman

[57] ABSTRACT

A convertible bed chair that can be easily changed from a chair to a bed comprises a pair of horizontally spaced arms having crossbars there between forming a main frame which supports three interconnected cushion-support flat frame assemblies. A single movable cushion is slidably attached to the frame assemblies and the flat frame assemblies are removably attached to the main frame and to a movable seat structure which telescopically engages the main frame and moves over the crossbars.

5 Claims, 6 Drawing Figures

CONVERTIBLE BED CHAIR

This is a continuation in part application of application Ser. No. 06/575,305, filed Jan. 30, 1984, now abandoned.

BACKGROUND OF THE INVENTION

1. Field of Invention

This invention relates to convertible chairs of the type using the seat and back cushions to form a horizontal bed.

2. Description of the Prior Art

Prior art devices have used a number of different ways to position cushions in horizontal alignment to form a bed. See for example U.S. Pat. Nos. 3,867,730, 4,292,697, 4,343,508 and 4,378,609.

In U.S. Pat. No. 3,867,730, a base frame 10 attached to spaced arms supports three interconnected frame sections, one of which has stringers 21 thereunder and a transverse support member at its forward edge. The stringers slidably engage the base frame. In the present invention there are only the spaced arms, a pair of spaced crossbars connecting the arms and a movable seat structure having wheels which is movable into and out of the space between the arms. A device similar to that of U.S. Pat. No. 3,867,730 is found in U.S. Pat. No. 4,292,697 and again in U.S. Pat. No. 4,343,508. U.S. Pat. No. 4,343,508 has a tubular metal frame supporting a back and seat with a bed extension hinged to the back and movable outwardly away from the seat to form a bed. Folding legs are provided to support the bed extension.

U.S. Pat. No. 4,378,609 discloses a device comparable with that of U.S. Pat. No. 4,343,508 except that the bed extension moves forwardly of the device which has a frame formed of a pair of spaced arms, a back portion interconnecting the arms and a comparable front portion interconnecting the arms over which the seat portion is elevated by levers and moved upwardly and outwardly over the same to a bed configuration. None of these prior art patents disclose a simple, inexpensive novel arrangement of the pair of spaced arms, the pair of crossbars interconnecting the same and a wheeled seat portion movable generally horizontally in and out of the space between the arms with a portion of the seat portion moving in under the crossbars and a portion moving over the same.

Applicant's convertible bed chair mounts a flat cushion support frame on the wheeled support and another on one of the crossbars with an intermediate frame pivoted there between and slidably secures a cushion on said cushion support frame.

DESCRIPTION OF THE PREFERRED EMBODIMENT

Figure 1:
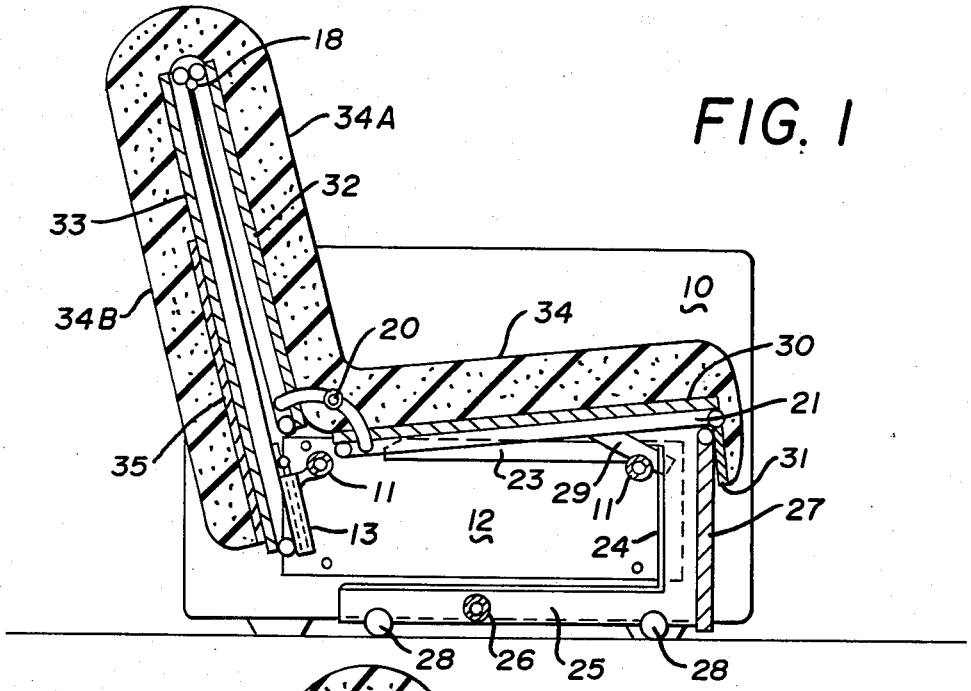
FIG. 1 is a vertical section of the convertible bed chair in chair configuration with one of the arms removed.
Figure 2:
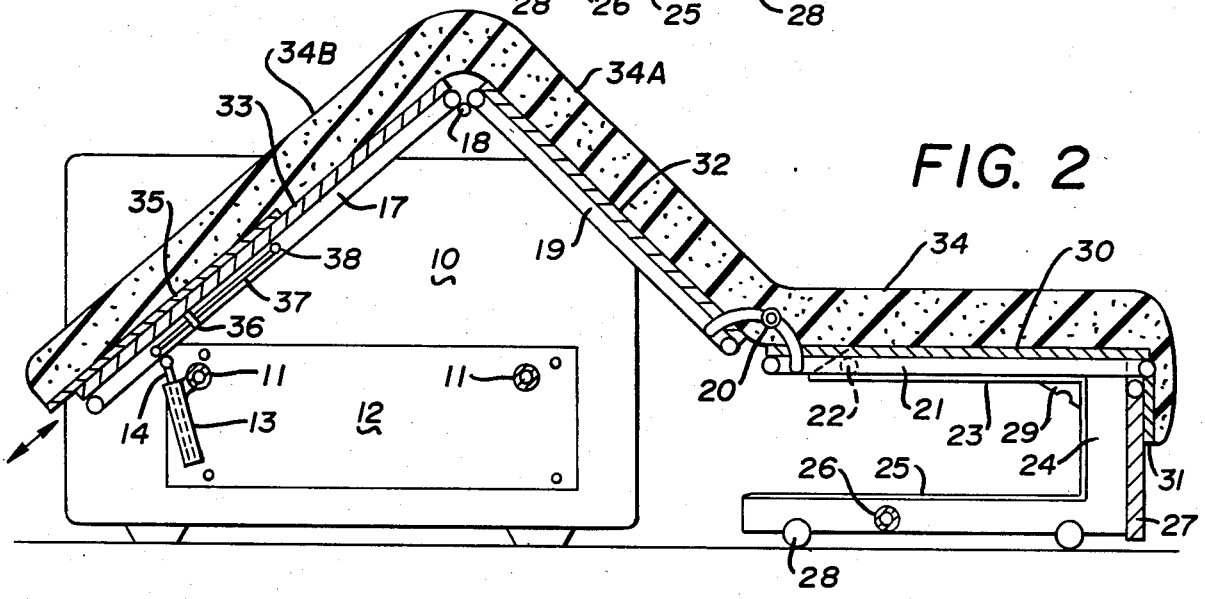
FIG. 2 is a vertical section of the convertible bed chair in a partially open configuration.
Figure 3:
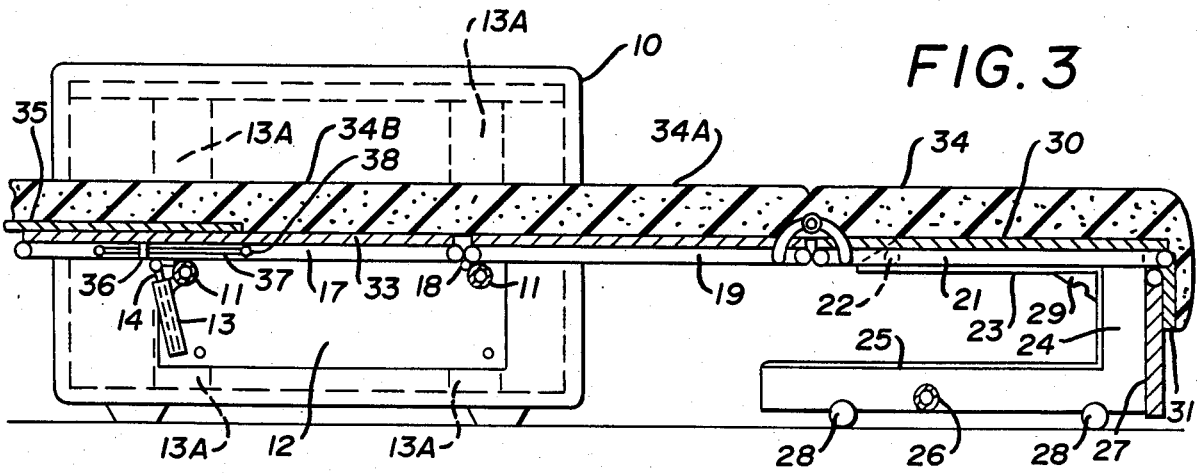
FIG. 3 is a vertical section of the convertible bed chair in open-bed configuration.
Figure 4:
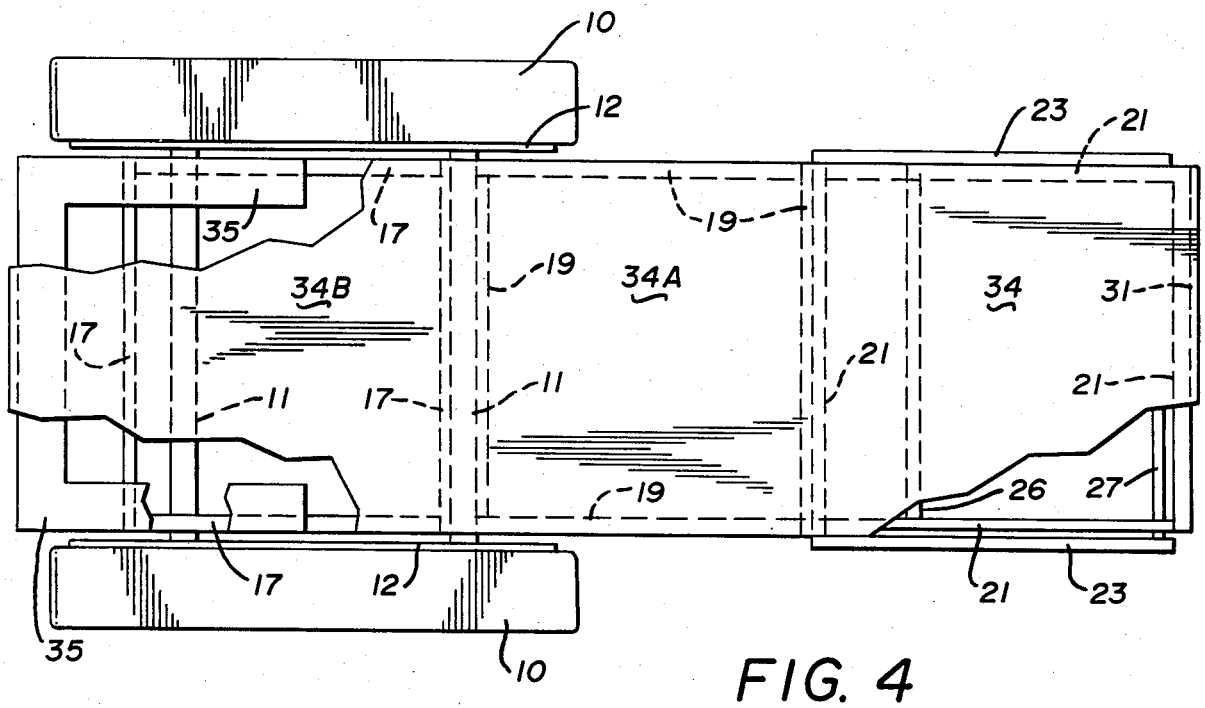
FIG. 4 is a top plan view of the convertible bed chair with parts broken away.
Figure 6:
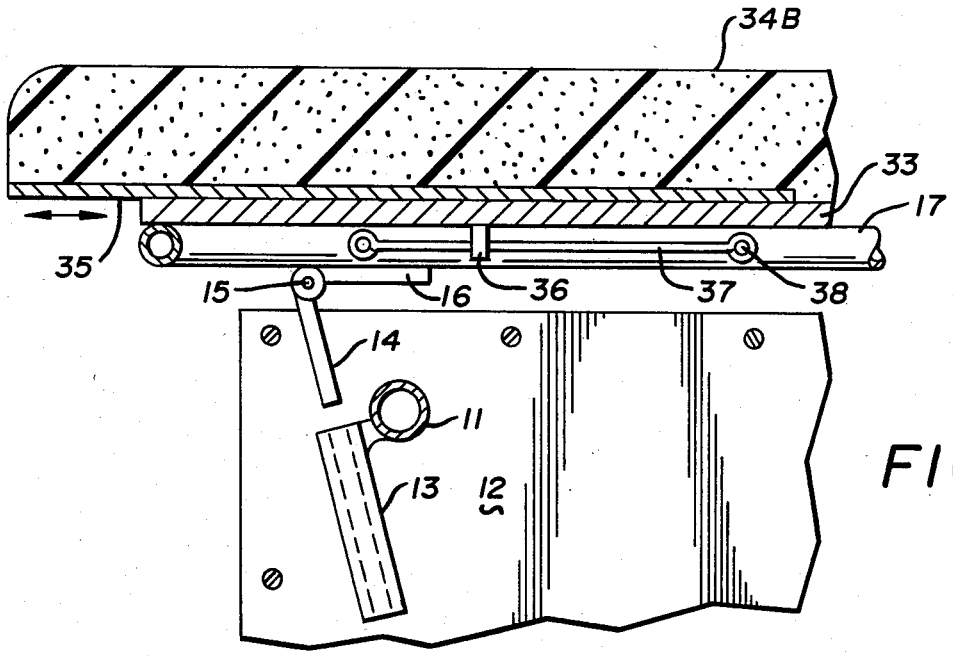

As seen in FIGS. 1, 2 and 3 of the drawings, the convertible bed chair comprises a pair of spaced vertically standing arms 10 having front and back portions and each having a pair of feet. Two horizontally spaced transversely extending crossbars 11 are attached at their respective ends to metal plates 12 which in turn are attached to the inner sides of the arms 10 and more particularily to reinforcing members therein. The crossbars 11 are the only structure connecting the arms 10 of the convertible bed chair. A pair of angularly disposed tubular sockets 13 are affixed to one of the crossbars 11 and removably receive pins 14 which are pivotly secured by pivots 15 to members 16 which are in turn attached to the opposite lower sides of a first flat frame 17, all as best illustrated in FIG. 6 of the drawings. The first flat frame 17 is tubular, substantially square in shape, and is hingedly affixed by hinges 18 to a second flat frame 19 which is formed of tubular members and is also substantially square shaped which in turn is hingedly affixed by hinges 20 to a third flat frame 21 which is formed of tubular members and is of substantially square shape. The third flat frame 21 is pivotaly attached by pivots 22 to a horizontally spaced pair of horizontally disposed frames 23 which are integratly formed with vertical frames 24 which in turn are integratly formed with a lower pair of horizontal frames 25. It will be seen that the frames 23, 24 and 25, which are interconnected by a crossframe 26 which extends between the lower horizontal frame members 25 and a transversely positioned recangularly shaped front frame 27. Wheels at 28 are rotatably mounted on stub shafts attached to the horizontal frame portions 25 so that the device comprises a wheeled seat support which is of a size and shape enabling it to be moved from the space between the arms 10 as shown in FIG. 1 of the drawings to a position forwardly of the front portions of the arms 10 as shown in FIGS. 2, 3 and 4 of the drawings. The shape of the horizontal frame members 23, the vertical frame members 24 and the lower horizontal frame members 25 resembles a reversed 'C' in configuration with the space between the open portion of the 'C' shape being sufficient to move over the crossbars 11 which extend between the plates 12, attached to the arms 10.

By referring to FIG. 1 of the drawing, the wheeled seat support just described will be seen to be so positioned between the arms 10 and it will be seen that a pair of notched arms 29 are attached to the third flat frame 21 and depend on an angle therefrom and that the notches therein have engaged the forward one of the crossbars 11 and elevated the third flat frame 21 with respect to its pivotal relation to the upper horizontally disposed frames 23. It will also be seen that a thin flat substantially square body member 30 is attached to the third flat frame 21 as is a vertically disposed rectangular body member 31. A second thin flat body member, 32 is attached to the second flat frame 19 and a third thin flat body member 33, is attached to the first flat frame 17. The body members 30, 32 and 33 form a support for a single elongated cushion 34. By referring to FIGS. 1, 2 and 3 of the drawings, it will be seen that the elongated cushion 34 takes the form of a cushioned seat member when it is in a substantially horizontally position and inclined substantially vertical cushioned back member 34-A and a depending angularily disposed section 34-B when the convertible bed chair is in chair configuration.

It will also be seen that the section 34-B, of the cushion 34, has a U-shaped reinforcing frame 35 affixed thereto which slidably engages the thin flat body member 33 as the cushion 34, and more particularily its sections 34-A and 34-B, change their length as they move from the positions illustrated in FIG. 1 of the drawings to the positions illustrated in FIGS. 2, 3 and 4 of the drawings. The U-shaped reinforcing frame 35 supports the extending portion of the section 34-B of the cushion 34 when the same moves outwardly beyond the thin flat body member 33 as illustrated by the directional arrows in FIGS. 2 and 6 of the drawings.

By referring now to FIG. 6 of the drawings, it will be seen that the first flat frame 17, of the convertible bed chair, supports the thin flat body member 33 on which the one-piece cushion 34 and more particularily its end portion 34-B rests, illustrates the U-shaped reinforcing frame 35 in extended relation to the first flat frame 17, as herein before described. It will occur to those skilled in the art that the thin flat body member 33 also moves relative to the first flat frame 17 as may be seen by comparing the relative position of the same to the other thin flat body members 30 and 32 as seen in FIGS. 1, 2 and 3 of the drawings, and that provision is made for controlling the position of the thin flat body member 33 with respect to the first flat frame 17 and comprises an apertured fixture 36 on either side of the flat frame 17 through which an elongated guide rod 37 extends. The ends of the elongated guide rod being offset with respect to the remainder thereof and secured by fasteners 38 to the flat frame 17. The construction is necessary to maintain the respective thin flat body member 33 in desirable operative position on the first flat frame 17 when the convertible bed chair is moved from chair configuration to bed configuration. In FIG. 4 of the drawings, the utility of the U-shaped reinforcing frame 35 is emphasized in that it is illustrated in extending relation to the first flat frame 17 as necessary to properly support the end portion 34-B of the single cushion 34.

Figure 5:
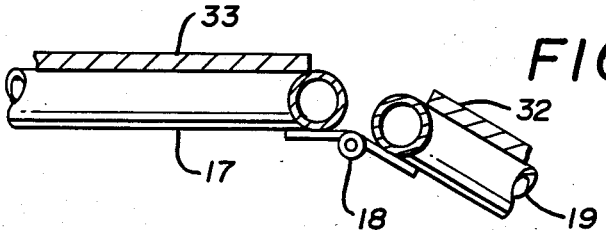
FIG. 5 is an enlarged detail of a hinge connecting two of the flat frame portions seen in FIGS. 1–3 and FIG. 6 is an enlarged vertical section of a portion of the convertible bed chair seen in FIGS. 1–3.

FIG. 5 shows a substantially enlarged view of the hinges 18, which join the flat frames 19 and 17, respectively. The thin flat body members 32 and 33 are secured to the flat frames 19 and 17, respectively, and the thin flat body member 30 is secured to the third flat frame 21. It will thus be seen that a very simple and inexpensive construction has been devised and disclosed herein which is capable of economic manufacture when compared with the prior art devices as there are only the two arms 10, the transversely positioned crossbars 11 and the three flat frames with their thin flat body members necessary to form the entire operable structure which positions the cushion 34 and its sections 34-A and 34-B in either the chair configuration as seen in FIG. 1 of the drawings and intermediate position as seen in FIG. 2 of the drawings or a bed configuration as seen in FIGS. 3, 4 and 6 of the drawings.

Although but one embodiment of the present invention has been illustrated and described, it will be apparent to those skilled in the art that various changes and modifications may be made therein without departing from the spirit of the invention and having thus described my invention, what I claim is:

1. A convertible bed chair comprising spaced vertically standing arms with front and back portions, means for spacing said arms horizontally, said means consisting of metal plates on the inner sides of said arms in oppositely disposed relation and horizontally spaced cross bars extending between said metal plates and directly affixed thereto, a C-shaped seat support movably positioned between said arms for movement on a horizontal plane from a first position between said arms to a second position outwardly of the front portions of said arms, upper and lower portions of said seat support freely spaced vertically whereby said upper portions may be moved above said cross bars and said lower portions may be moved below said cross bars, vertical front frames secured to said upper and lower portions and defining an outer end of said seat support and said convertible bed chair when in bed configuration and when in seat configuration, three flat tubular frames arranged in end to end relation and hinges joining said flat frames to one another, one of said flat frames disposed on said seat support and means pivoting said one flat frame to said seat support, means detachably and pivotally connecting another of said flat frames to one of said cross bars, flat body members positioned on said flat frames and a single elevated cushion positioned on said flat body members for movement with respect thereto when said convertible bed chair is changed from a bed configuration to a chair configuration and vice versa and means slidably securing one of said flat body members to one of said flat tubular frames so as to permit relative longitudinal movement.

2. The convertible bed chair set for the in claim 1 and wherein said upper and lower portions and said vertical front frames of said seat support are integral C-shaped members and wherein cross frames interconnect said lower portions.

3. The convertible bed chair set forth in claim 1 and wherein a flat reinforcing frame is attached to one end of said single cushion whereby to support said one end of said single cushion when said one end moves longitudinally along from said flat body members when said convertible bed chair is changed from a chair configuration to a bed configuration.

4. The convertible bed chair set forth in claim 1 and wherein appertured brackets are positioned on at least one of said flat body members and rods are positioned through said appertured brackets and attached to said flat frames whereby to movably retain said flat body members on said flat frames.

5. The convertible bed chair set forth in claim 1 and wherein said means detachably and pivotly connecting one of said flat frames to one of said crossbars comprises tubular sockets mounted on said crossbar and hinges having parts attached to said flat frame and parts engagable in said tubular sockets.

* * * * *